United States Patent [19]

Hamisch, Jr.

[11] 4,207,818

[45] Jun. 17, 1980

[54] INK ROLLER AND METHOD OF MAKING SAME

[75] Inventor: Paul H. Hamisch, Jr., Franklin, Ohio

[73] Assignee: Monarch Marking Systems, Inc., Dayton, Ohio

[21] Appl. No.: 945,021

[22] Filed: Sep. 22, 1978

[51] Int. Cl.[2] ..... B41F 1/46

[52] U.S. Cl. ..... 101/348; 264/23; 403/270; 101/205; 101/211

[58] Field of Search ..... 101/348, 205, 211; 264/23, DIG. 68; 403/265, 270, 360

[56] References Cited

U.S. PATENT DOCUMENTS

| | | | |
|---|---|---|---|
| 3,878,783 | 4/1975 | Hamisch, Jr. | 101/348 |
| 3,905,296 | 9/1975 | Washschynsky | 101/348 |
| 3,928,521 | 12/1975 | Haren et al. | 101/348 |

FOREIGN PATENT DOCUMENTS

| | | | |
|---|---|---|---|
| 627319 | 12/1961 | Belgium | 101/348 |
| 2321415 | 11/1973 | Fed. Rep. of Germany | 101/348 |

OTHER PUBLICATIONS

"Molding Platens & Rubber Covered Rollers," IBM Tech. Discl. Bulletin, vol. 16, No. 4, Sep. 1973, pp. 1097–1098.

"How to Ultrasonically Weld the New Engineering Thermoplastics," Kish, Plastics Technology, Sep. 1972, pp. 40–42.

*Primary Examiner*—E. H. Eickholt

*Attorney, Agent, or Firm*—Joseph J. Grass

[57] ABSTRACT

There is disclosed an ink roller adapted to be used in a printing apparatus. The ink roller includes a hub having a roll-mounting section, a flange section, a first stub shaft adjacent the first flange section and a second stub shaft disposed opposite the first stub shaft and joined to the roll-mounting section. A second flange section telescopically receives and is axially aligned with the roll-mounting section. The second flange section is joined to the hub preferably by ultrasonic welding. There is also disclosed method of making the ink roller.

12 Claims, 3 Drawing Figures

INK ROLLER AND METHOD OF MAKING SAME

BACKGROUND OF THE INVENTION

1. Field of the Invention

This invention relates to the art of ink rollers and method of making ink rollers.

2. Brief Description of the Prior Art

U.S. Pat. No. 3,878,783 of Paul H. Hamisch, Jr. discloses an ink roller having a pair of connected hub sections and a roll of ink-receptive material.

SUMMARY OF THE INVENTION

This invention relates to a low-cost, easy to manufacture and reliable ink roller and to a method of making same. The ink roller according to a specific embodiment of the invention includes a one-piece hub having a roll-mounting section, a first flange section joined to one end portion of the roll-mounting section, a first stub shaft at one end portion of the roll-mounting section adjacent the first flange section and a second stub shaft joined to the other end portion of the roll-mounting section. The roll-mounting section, the first flange section, and the first and second stub shafts are axially aligned. A second flange section telescopically receives the roll-mounting section to locate the second flange section axially aligned with the axis of the hub. The second stub shaft extends through a hole in the second flange section. There is preferably an energy director between the second flange section and the roll-mounting section which is melted ultrasonically to permanently join the second flange section to the roll-mounting section. It is preferred that the weld be continuous to avoid any possibility of ink seeping onto the second stub shaft. The ink roller of the invention is made by slipping the ink-receptive roll onto the roll-mounting section, aligning the second flange section with the axis of the hub, and joining the second flange section to the roll-mounting section preferably by ultrasonic welding.

DESCRIPTION OF THE PREFERRED EMBODIMENT

Figure 1:
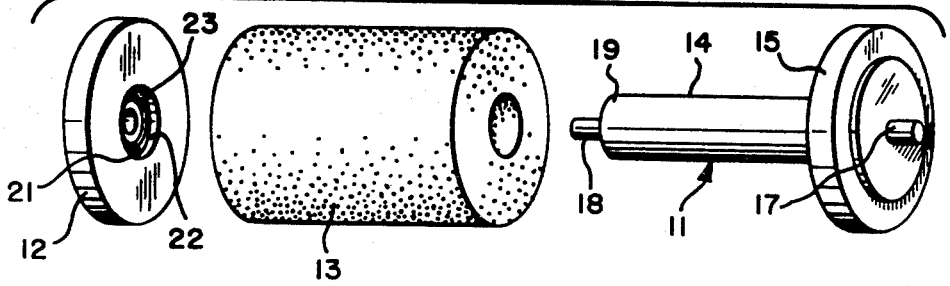
FIG. 1 is an exploded view of the inking roll assembly showing the hubs, hub shaft and inking roll of the assembly.

With reference to the drawings, there is shown an ink roller generally indicated at 10. In the preferred embodiment shown, the ink roller 10 has three parts; namely, a one-piece hub generally indicated at 11, a flange section 12, and a tubular porous ink-receptive roll 13. The hub 11 and the flange section 12 are each shown to be of one-piece molded plastics construction. The hub 11 and the flange section 12 are preferably composed of the same thermoplastic material. The hub 11 includes a roll-mounting section 14 on which the roll 13 is received, an annular flange section 15 having a circular outer periphery joined to one end portion 16 of the roll-mounting section 14, a stub end or stub shaft 17 joined to the flange section 15, and a stub end or stub shaft 18 joined to the other end portion 19 of the roll-mounting section 14. The stub shafts 17 and 18 have respective annular outer surfaces of the same diameter, although the stub shaft 18 is longer than the stub shaft 17. However, the portion of the stub shaft 18 which extends beyond the flange section 12 is equal in length to the length of the stub shaft 17. The stub shafts 17 and 18 enable the ink roller 10 to be rotatably mounting, as is the ink roller shown, for example, in U.S. Pat. No. 3,878,783.

The flange section 12 is shown to have a hole 20 which extends entirely through the flange section 12. As is preferred, there is clearance between the stub shaft 18 and the inside of the hole 20. The flange section 12 has an internal recess 21. The recess 21 has a wall or shoulder 22 which is illustrated as being continuous and annular. The wall 22 is shown to extend in an axial direction.

Figure 3:
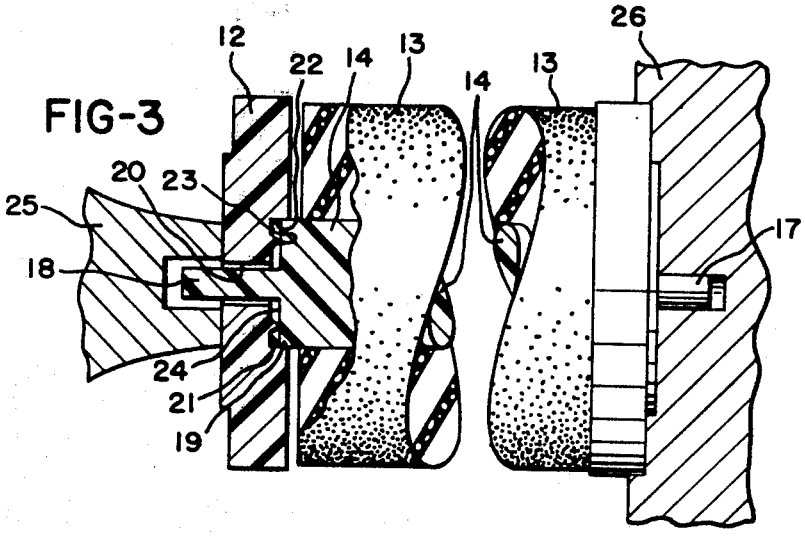
FIG. 3 is a partially sectioned view of the inking roll assembly being manufactured using an ultrasonic welding horn system.

With reference to FIG. 3, there is illustrated a method by which the ink roller 10 is made. The flange section 12 has a projection or energy director 23 which extends in an axial direction and is joined to the end or end wall of the recess. The projection 23 is shown to be a continuous annular bead or ridge which is V-shaped in section. The energy director 23 concentrates heat at the place where the energy director contacts the end portion 19 of the roll-mounting section 14. In FIG. 3, the pointed end of the energy director 23 is in contact with the end portion 19, and specifically is in contact with the terminal end or end wall 24 of the end portion 19. FIG. 3 also shows the recess 21 of the flange section 12 as telescopically receiving end portion 19 in axial alignment with axis of the hub 11. The shoulder 22 accurately locates the flange section 12 on the end portion 19. In that the flange sections 12 and 15 can serve as bearings, axial alignment is important. The end of the roll 13 is also shown spaced from the flange section 12.

Figure 2:
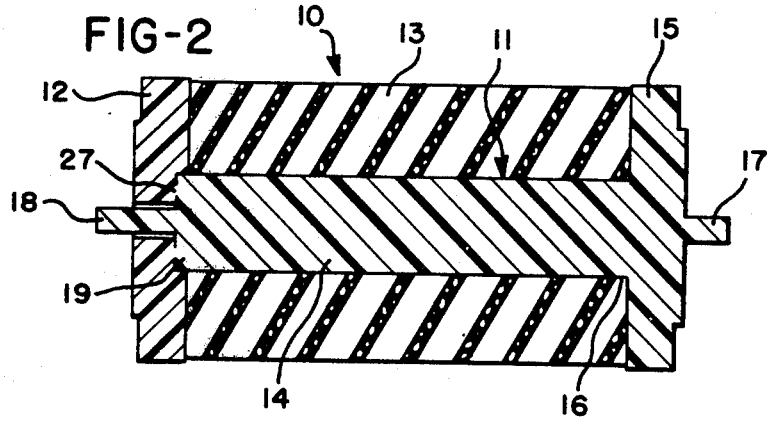
FIG. 2 is a sectional view of the inking roll assembly taken along the longitudinal axis thereof.

FIG. 3 also shows an ultrasonic welding horn 25 and a back-up member 26. With the ink roller components assembled as shown, the horn 25 is operated while the horn 25 and the back-up member 26 are moved relatively toward each other, thereby causing the energy director 23 and the adjacent material of the end portion 19 to melt, causing the flange section 12 to move into contact with the end of the roll 13, and forming a weld 27 between the flange section 12 and the hub 11 to provide a unitized assembly. The resultant ultrasonic weld is indicated at 27 in FIG. 2. In that the energy director 23 is continuous, a continuous weld is made when the ultrasonic horn 25 is energized, thereby preventing ink contained in the roll 13 from seeping onto the stub shaft 18. The weld 27 prevents the flange section 12 from separating from the hub 11 during use.

Although the energy director 23 is shown to have been molded as part of the flange section 12, it can alternately be molded as part of the terminal end 24 of the roll-mounting section 14.

Other embodiments and modifications of this invention will suggest themselves to those skilled in the art, and all such of these as come within the spirit of this invention are included within its scope as best defined by the appended claims.

I claim:

1. An ink roller, comprising: a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having annular outer surfaces by which the roller can be rotatably mounted, a shoulder on the second flange section for receiving the second end portion of the roll-mounting section to locate the second flange section coaxially with respect to the axis of the hub, an ink-receptive tubular porous roll received by the roll-mounting section between the first and second flange sections, and means for permanently joining the second end portion of the roll-mounting section and the second flange section.

2. An ink roller as claimed in claim 1, wherein the shoulder is generally annular and defines the periphery of an axially extending recess.

3. An ink roller as claimed in claim 1, wherein the ink roller consists of the hub, the second flange section and the ink roll.

4. An ink roller, comprising: a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having annular outer surfaces by which the roller can be rotatably mounted, a shoulder on the second flange section for telescopically receiving the second end portion of the roll-mounting section to locate the second flange section coaxially with respect to the axis of the hub, an ink-receptive tubular porous roll received by the roll-mounting section between the first and second flange sections, and an ultrasonic weld integrally joining the second end portion of the roll-mounting section and the second flange section.

5. An ink roller, comprising: a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having annular outer surfaces by which the roller can be rotatably mounted, means for locating the second flange section coaxially with respect to the axis of the hub, an ink-receptive tubular porous roll received by the roll-mounting section between the first and second flange sections, and an ultrasonic weld integrally joining the second end portion of the roll-mounting section and the second flange section.

6. An ink roller as claimed in claim 5, wherein the hub and the second flange section are composed of the same thermoplastic material.

7. Method of making an ink roller, comprising the steps of: providing a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having annular outer surfaces by which the roller can be rotatably mounted, the second flange section having a shoulder, and an ink-receptive tubular porous roll on the roll-mounting section; sliding the second flange section onto the hub and using the shoulder to locate the second flange section about the second stub shaft coaxially with respect to the axis of the hub; and permanently joining the second end portion of the roll-mounting section and the second flange section.

8. Method of making an ink roller, comprising the steps of: providing a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having annular outer surfaces by which the roller can be rotatably mounted, the second flange section having a shoulder; sliding an ink-receptive tubular porous roll onto the roll-mounting portion; sliding the second flange section onto the hub and using the shoulder to locate the second flange section about the second stub shaft coaxially with respect to the axis of the hub; and ultrasonically welding the second flange section to the second end portion of the roll-mounting section.

9. Method of making an ink roller, comprising the steps of: providing a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having respective annular outer surfaces by which the roller can be rotatably mounted; sliding an ink-receptive tubular porous roll onto the roll-mounting section; locating the second flange section about the second stub shaft coaxially with respect to the axis of the hub; and ultrasonically welding the second flange section to the second end portion of the roll-mounting section.

10. Method of making an ink roller, comprising the steps of: providing a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second flange section having respective annular outer surfaces by which the roller can be rotatably mounted, with an energy director being provided at the interface between the second flange section and the roll-mounting section; sliding an ink-receptive tubular porous roll onto the roll-mounting portion; locating the second flange section about the second stub shaft coaxially with respect to the axis of the hub, and ultrasonically welding the second flange section to the second end portion of the roll-mounting section at the energy director.

11. Method of making an ink roller as claimed in claim 10, wherein the step of providing the hub and the second flange section includes providing an energy director which is continuous and completely surrounds said stub shaft so that the weld is continuous.

12. Method of making an ink roller, comprising the steps of: providing a one-piece hub composed of molded plastics material and having a roll-mounting section, a first annular flange section, a first stub shaft and a second stub shaft, the first flange section being disposed adjacent a first end portion of the roll-mounting section and adjacent the first stub shaft, the second stub shaft being joined to a second end portion of the roll-mounting section, the roll-mounting section, the first annular flange section, the first stub shaft and the second stub shaft being coaxial, a one-piece annular second flange section composed of molded plastics material, the second flange section having a hole through which the second stub shaft extends, the first stub shaft and the portion of the second stub shaft which extends outwardly beyond the second stub shaft having respective annular outer surfaces by which the roller can be rotatably mounted, the second flange section having a shoulder, with an energy director being provided at the interface between the second flange section and the roll-mounting section; sliding an ink-receptive tubular porous roll onto the roll-mounting section; and ultrasonically welding the second flange section to the second end portion of the roll-mounting section at the energy director.

* * * * *